US006746283B2

(12) United States Patent
Arnett et al.

(10) Patent No.: US 6,746,283 B2
(45) Date of Patent: Jun. 8, 2004

(54) TERMINAL HOUSING FOR A COMMUNICATION JACK ASSEMBLY

(75) Inventors: Jaime R. Arnett, Fishers, IN (US); Richard Y. Mei, McKinney, TX (US); Paul J. Straub, Mooresville, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 101 days.

(21) Appl. No.: 10/076,933

(22) Filed: Feb. 15, 2002

(65) Prior Publication Data

US 2003/0157842 A1 Aug. 21, 2003

(51) Int. Cl.[7] ..... H01R 24/00
(52) U.S. Cl. ..... 439/676; 439/941; 439/404
(58) Field of Search ..... 439/676, 404, 439/405, 941

(56) References Cited

U.S. PATENT DOCUMENTS

| | | | | |
|---|---|---|---|---|
| 3,027,536 | A | 3/1962 | Pasternak | |
| 3,798,587 | A | 3/1974 | Ellis, Jr. et al. | |
| 4,136,628 | A | 1/1979 | McGonigal et al. | 113/119 |
| 4,206,964 | A | 6/1980 | Olsson | |
| 4,262,985 | A | 4/1981 | Muehlhausen, II | |
| 4,826,449 | A | 5/1989 | Debortoli et al. | 439/411 |
| 5,096,442 | A | 3/1992 | Arnett et al. | 439/676 |
| 5,186,647 | A | 2/1993 | Denkmann et al. | 439/395 |
| D345,268 | S | 3/1994 | Pate | D6/511 |
| 5,299,956 | A | 4/1994 | Brownell et al. | 439/638 |
| 5,432,484 | A | 7/1995 | Klas et al. | 333/1 |
| 5,580,270 | A | 12/1996 | Pantland et al. | 439/395 |
| 5,924,896 | A | 7/1999 | Arnett et al. | 439/676 |
| 5,947,772 | A | 9/1999 | Arnett et al. | 439/676 |
| 5,975,919 | A | 11/1999 | Arnett et al. | 439/82 |
| 6,093,048 | A | 7/2000 | Arnett et al. | 439/404 |
| 6,135,829 | A | 10/2000 | Johnston | 439/874 |
| 6,162,077 | A | 12/2000 | Laes et al. | 439/188 |
| 6,196,880 | B1 | 3/2001 | Goodrich et al. | 439/676 |
| 6,283,768 | B1 | 9/2001 | Van Naarden | 439/76.1 |
| 6,312,290 | B1 | 11/2001 | Belopolsky | 439/676 |

*Primary Examiner*—Javaid H. Nasri
(74) *Attorney, Agent, or Firm*—Thomas, Kayden, Horstemeyer & Risley, LLP

(57) ABSTRACT

A terminal housing for a communication jack assembly is disclosed. A representative embodiment of a terminal housing body for receiving a wire pair, the terminal housing body having a front end and a rear end, includes a base wall having a top portion. The terminal housing body also includes a channel formed in the top portion of the base wall for receiving the wire pair. The channel is adapted to guide the direction of the wire pair. The body further includes a plurality of wire guide posts extending from the top portion and joined by the base wall and running along opposing sides of the top portion of the base wall of the terminal housing body. Grooves separated by adjacent ones of the wire guide posts have openings into the channel for receiving the wires of the wire pair are also included in the body.

49 Claims, 5 Drawing Sheets

TERMINAL HOUSING FOR A COMMUNICATION JACK ASSEMBLY

FIELD OF THE INVENTION

The present invention relates to connectors for communication wires and cables, and particularly to a connector terminal housing in a communication jack assembly.

DESCRIPTION OF THE RELATED ART

A compact communications jack connector is disclosed in U.S. Pat. No. 5,096,442 (issued Mar. 17, 1992). The known connector is formed from a unitary lead frame in which eight flat, elongated conductive elements connect spring jackwire terminals at one end of the frame with corresponding wire connection terminals at the other end of the frame. The wire connection terminals are insulation displacement connectors (IDCs) of the "slotted-beam" type. For example, see U.S. Pat. No. 3,027,536 (issued Mar. 27, 1962); U.S. Pat. No. 3,798,587 (issued Mar. 19, 1974) and U.S. Pat. No. 4,826,449 (issued May 2, 1989).

In U.S. Pat. No. 5,096,442 discussed above (hereinafter the '442 patent), the lead frame is placed against a bottom surface of a dielectric spring block, the jackwire terminals are wrapped around a tongue-like protrusion on the block, and the elongated conductive elements are positioned flat and parallel to one another on the block bottom surface. Individual IDC terminals of the lead frame are folded onto side surfaces of the block. Slots in the IDC terminals align with corresponding wire-receiving slots formed in the block, and a cover is placed around the block including the wrapped IDC terminals. The tongue-like protrusion of the block is received in a jack frame, and the jackwire terminals are aligned so that, when a connecting plug is inserted the jack frame, the jackwire terminals connect electrically with corresponding wire leads in the plug.

A communication jack made by AMP Corporation (Part No. 557901-1) and intended for high data rate applications includes a printed wire board, jackwires that emerge from a top surface of the board and bend sharply back over the board, and sets of wire connection terminals at the sides of the board. Two separate terminal covers are each held in place by pins which pass horizontally through openings in the terminal bases. The top surface of the wire board is left exposed between the separated terminal covers. A front end of the board slides into a jack frame, and tabs on the sides of the board snap in slots in rear sidewalls of the jack housing. The jack housing also has a rear bottom wall that extends over the bottom surface of the wire board.

U.S. Pat. No. 5,186,647 (issued Feb. 16, 1993), which is incorporated herein in its entirety, shows a high frequency electrical connector similar to the mentioned U.S. Pat. No. 5,096,442; but wherein certain pairs of the parallel conductive elements cross over one another as a means for reducing crosstalk. Other arrangements for reducing crosstalk are disclosed by U.S. Pat. No. 5,432,484 (issued Jul. 11, 1995); U.S. Pat. No. 5,299,956 (issued Apr. 5, 1994); and U.S. Pat. No. 5,580,270 (issued Dec. 3, 1996) each of which is incorporated herein by reference in its entirety.

It is also known to construct a terminal post with a retaining portion formed of two arcuate spring members which are separated by an opening, thus resembling a "needle eye". See, for example, U.S. Pat. No. 4,206,964 (issued Jun. 10, 1980). See also Design Patent No. 345,268 (issued Jan. 10, 1995) showing a telecommunications terminal clip having a slotted retaining portion. U.S. Pat. No. 4,136,628 (issued Jan. 30, 1979) and U.S. Pat. No. 4,262,985 (issued Apr. 21, 1981) show IDC terminals that are formed to be mounted inside of connector modules or housings.

U.S. Pat. No. 5,924,896 (issued Jul. 20, 1999), which is incorporated herein in its entirety, discloses a communication jack assembly suitable for high data rate applications. The communication jack of U.S. Pat. No. 5,924,896 (hereinafter the '896 patent) includes a wire board having conductive paths that extend between a jackwire terminal region at a first portion of the board and a wire-connection terminal region at a second portion of the board. A number of spring jackwires extend through the jackwire terminal region, to connect with a communication plug when placed in the jackwire terminal region. The jackwires connect at one end to corresponding conductive paths on the wire board, and the conductive paths form a part of at least one communications signal path when the plug is connected to the jackwires. The conductive paths may be configured to compensate for crosstalk otherwise developed in a signal path once the plug is mated with the jack. A dielectric terminal housing is formed to protect the wire-connection terminal region on top of the wire board, and a cover is formed to protect the connection terminal region on the bottom of the board. The wire board is captured between the housing and the cover when the housing and cover are joined to one another.

Unfortunately, the dielectric terminal housing of the '896 patent may produce variability in the wiring upon installation of the jack, particularly, upon termination of the wires into the housing. The quality of a communication channel lies in the quality of the medium in which the data is being communicated as well as the quality of the connections of the mediums. Variability in the connection of the jack may lead to undesirable results and inconsistencies (e.g. crosstalk errors). Due to the inconsistencies caused in the variability, errors cannot be consistently accounted for or rectified.

Accordingly, a need exists for a dielectric terminal housing that reduces the variability of the wiring during installation of the jack. In accordance with the present invention, variability can be reduced by eliminating termination techniques that lead to de-twisting of pairs, and/or that produce open loops. A need also exists for a housing that allows for easier wiring, and thus easier installation of the jack.

SUMMARY OF THE INVENTION

The present invention provides a terminal housing body for receiving a wire pair, the terminal housing body having a front end and a rear end, comprises a base wall having a top portion. The terminal housing body also comprises a channel formed in the top portion of the base wall for receiving the wire pair, the channel extending from the rear end toward the front end. The channel is adapted to guide the direction of the wire pair. The body further comprises a plurality of wire guide posts that extend from the top portion, are joined by the base wall, and ran along opposing sides of the top portion of the base wall from the rear end to the front end of the terminal housing body. Grooves separated by adjacent ones of the wire guide posts and having openings into the channel for receiving the wires of the wire pair are also included in the body.

In accordance with another embodiment, the present invention provides a communication jack assembly that includes a terminal housing portion for receiving a wire pair. The terminal housing portion has a front and a rear end, and includes a base wall having a top portion. The terminal housing portion further comprises a channel formed in the top portion of the base wall for receiving the wire pair and extending from the rear end toward the front end. The channel is adapted to guide the direction of the wire pair. The terminal housing portion further comprises a plurality of wire guide posts extending from the top portion and joined by the base wall and running along opposing sides of the top portion of the base wall from the rear end to the front end of the terminal housing portion. Grooves separated by adjacent ones of the wire guide posts and having openings into the channel for receiving the wires of the wire pair are also included in the housing portion.

In accordance with yet another embodiment, the present invention provides a terminal housing body for receiving a first wire pair, the terminal housing body having a front end and a rear end, includes a base wall having a top portion. The body further comprises a first channel formed in the top portion of the base wall for receiving the first wire pair and extending from the rear end toward the front end and a second channel formed in the top portion of the base wall for receiving a second wire pair and extending from the rear end toward the front end of the housing body. A plurality of wire guide posts extending from the top portion and joined by the base wall and running along opposing sides of the top portion of the base wall from the rear end to the front end of the terminal housing body are also included. The body further comprises grooves separated by adjacent ones of the wire guide posts that have openings into one of said first or second channels for receiving the wires of the first and second wire pairs and a divider formed from the base wall and extending upwards for separating the first channel from the second channel.

Embodiments of the present invention successfully overcome those aforementioned and/or other shortcomings of the prior art. Ease of installation is provided with channels and ramps. Angled grooves for receipt of wires provide for less open loops among twisted wire pairs, and a divider and separator are utilized to provide proper inter-wire pair spacing.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

As will be described in greater detail herein, embodiments of the present invention can reduce the variability of the wire termination during installation of a communication jack. A reduction in variability of the wiring allows for the communication jack to provide reliable and consistent performance. Embodiments of the terminal housing body and the communication jack also allow for easier wire termination and thus easier installation of the jack.

Figure 1:
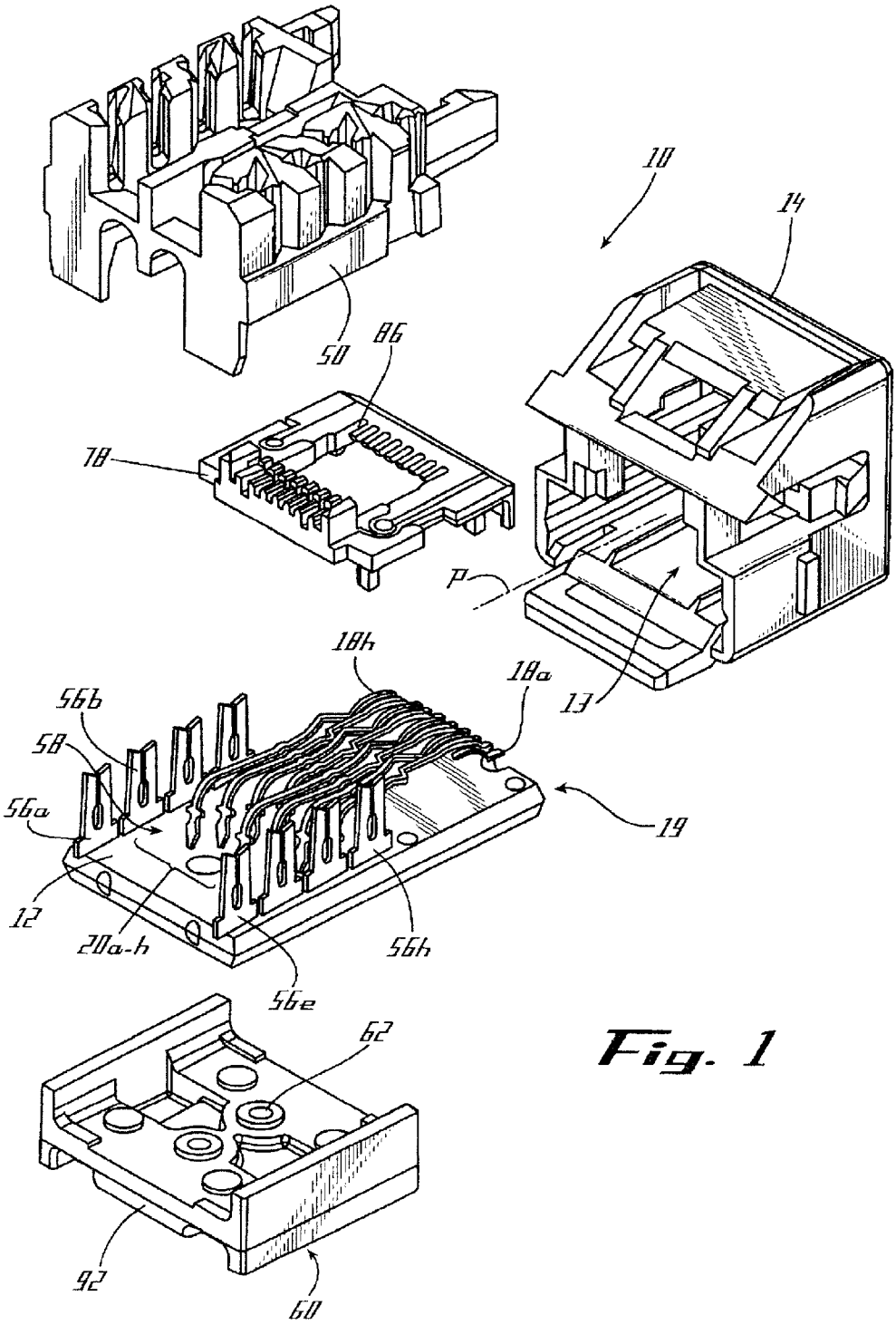
FIG. 1 is an exploded view of a high frequency communication jack assembly and a mating jack frame in accordance with embodiments of the present invention.

FIG. 1 is a perspective view of a communication jack assembly 10 in accordance with embodiments of the present invention. Also included in FIG. 1 is a communications jack frame or housing 14 with which the assembly 10 is associated. The jack housing 14 has a rear face in which a cavity 13 is formed. The cavity 13 has an axis P along the direction of which a terminal housing portion 50 and the wire board 12 may be inserted in the jack housing 14. A plug opening (not shown) is formed on the front side of the jack housing 14 for a mating plug to be placed.

In FIG. 1, the communication jack assembly 10 includes a generally rectangular printed wire board 12. The board 12 may be in the form of, e.g., a single or a multi-layer dielectric substrate. A number, e.g., eight elongated terminal contact wires 18*a*–18*h* extend in a generally horizontal direction with respect to a top surface of the wire board 12, substantially parallel to one another. The contact wires are generally uniformly spaced a certain distance (e.g., 0.090 inches) from the top surface of the wire board 12, and free end portions of the contact wires project beyond a front edge 19 of the board 12. The contact wires 18*a*–18*h* are also configured to deflect resiliently toward the board 12 when the wires are engaged by a mating connector along the direction of the plug opening axis P, i.e., in a direction parallel to the wire board 12.

The terminal contact wires 18*a*–18*h* may be formed from, e.g., a copper alloy such as spring-tempered phosphor bronze, beryllium copper, or the like. A typical cross-section for the contact wires 18*a*–18*h* is approximately 0.015 inches square.

The board 12 may incorporate electrical circuit components and devices arranged to compensate for connector-induced crosstalk. Such devices may include wire traces printed on or within layers of the board 12. Crosstalk compensation provided by the board 12 may be in addition to an initial stage of crosstalk compensation provided by the terminal contact wires 18*a*–18*h*, as explained below.

The terminal contact wires 18*a*–18*h* have associated base portions 20*a*–20*h* opposite their free end portions. Each base portion is formed to connect a contact wire to one or more conductors on or within the wire board 12. For example, the base portions 20*a*–20*h* may be soldered or press-fit in plated terminal openings formed through the board, to connect with corresponding conductive paths on or within the board. The base portions 20*a*–20*h* project in a generally normal direction with respect to the top surface of the wire board 12. The base portions 20*a*–20*h* enter the wire board 12 with a "duo diagonal" footprint. In other embodiments of the connector assembly 10, the base portions of the terminal contact wires enter the wire board with a "saw tooth."

An electrically insulative, dielectric terminal housing 50 covers a rear portion of the wire board 12. Outside insulated wire leads may be connected to upstanding terminals 56*a* to 56*h* on the board. The housing 50 is formed of a plastics or other insulative material that meets all applicable standards with respect to electrical insulation and flammability. Such materials include but are not limited to polycarbonate, ABS, and blends thereof. The housing 50 has, for example, at least one fastening or mounting post 52 (not visible) that projects from a bottom surface of the housing 50 to pass through one or more openings 58 in the board 12.

Terminals 56*a*–56*h* are mounted at opposite sides of the rear portion of the wire board 12. Each of the terminals 56*a*–56*h* has a mounting portion that is soldered or press fit in a corresponding terminal mounting hole in board 12, to connect via a conductive path (not shown) with a corresponding one of the terminal contact wires 18*a*–18*h*. When the terminal housing 50 is aligned above the IDC terminals 56*a*–56*h*, and the housing 50 is lowered to receive the IDC terminals 56*a*–56*h* in corresponding terminal slots (See FIG. 2) in the terminal housing 50, the fastening post 52 of the housing 50 aligns with the opening 58 in the board 12, and passes through to project below the board.

A cover 60 is formed of the same or a similar material as that of the terminal housing 50. The cover 60 is arranged to protect the rear portion of the wire board 12 from below. Cover 60 has at least one opening 62 which aligns with the tip of the fastening post 52 of housing 50 below the wire board 12. The board 12 is thus secured between the terminal housing 50 and the cover 60, and a tip of the housing fastening post(s) 52 (more than one may be available and utilized) is joined to the body of the cover 60. For example, a known ultrasonic welding process may be used to melt and fuse the post tip and the surrounding cover body with one another. With the wire board 12 thus captured between the terminal housing 50 and the cover 60, the rear portion of the wire board 12 is protectively enclosed.

FIG. 1 also shows a terminal wire guide block 78 mounted over the front edge 19 of the wire board 12. The guide block 78 has equi-spaced vertical guide ways 86. The free end portions of the terminal contact wires are arranged to extend within corresponding ones of guide ways 86, and to be guided individually for vertical movement when deflected by the terminals of a mating plug connector (not shown).

Figure 2:
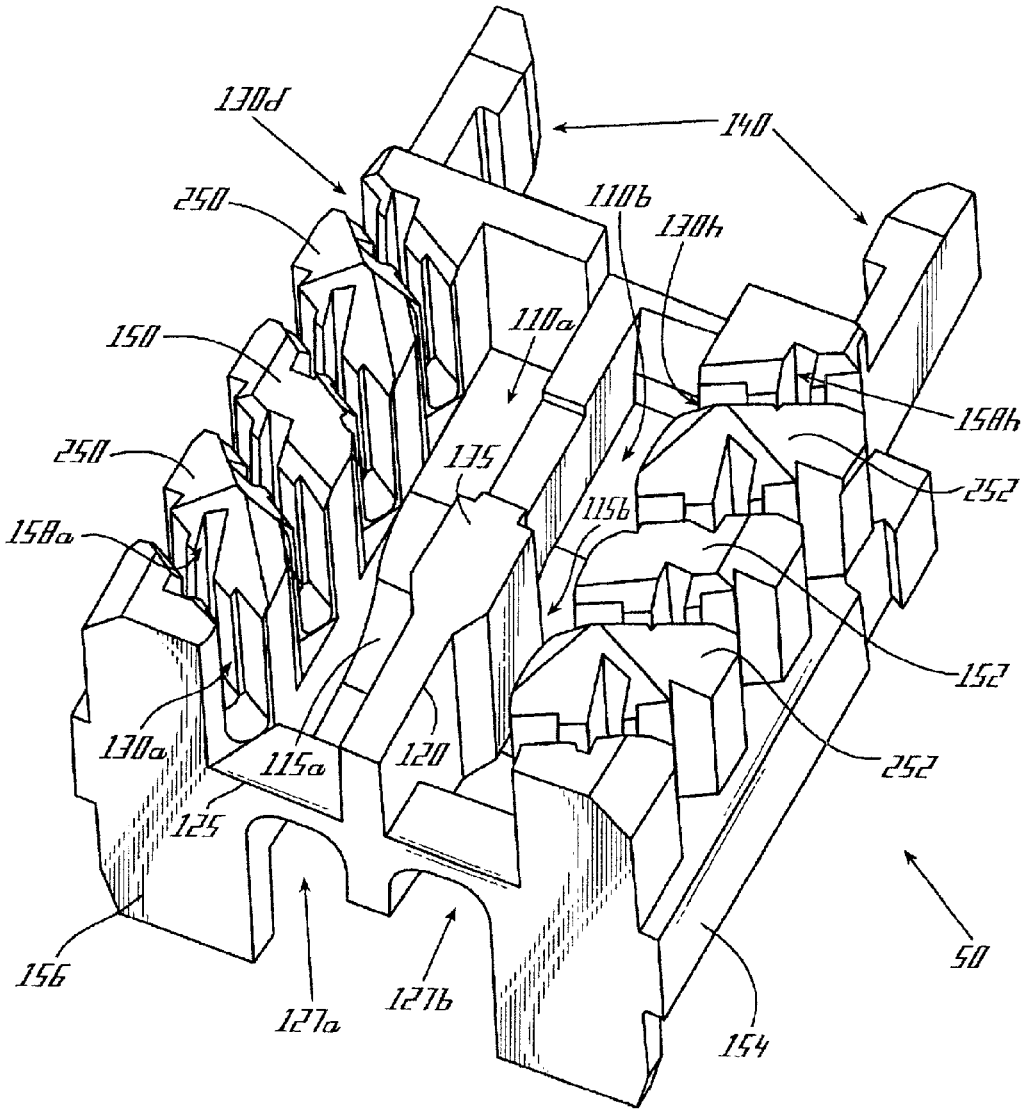
FIG. 2 is an enlarged perspective view of the terminal housing of FIG. 1.
Figure 3B:
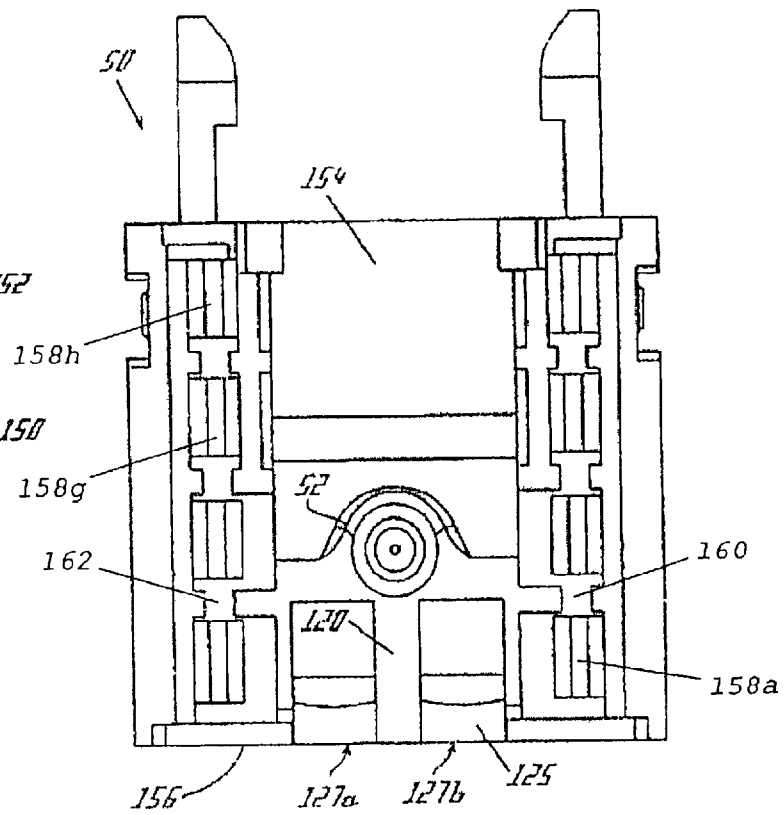
FIG. 3B is a bottom view of the terminal housing of FIG. 1, FIG. 2, and FIG. 3A.

FIG. 2 is a perspective view of the terminal housing 50 in accordance with embodiments of the present invention. Housing 50 is preferably molded as a single piece which defines two banks of IDC terminal wire guide posts 150, 152 at corresponding sides of the housing 50. The two banks of wire guide posts 150, 152 are joined by an integral base wall 154. The housing fastening post 52 (not visible) projects from the bottom of the base wall 154, as shown in FIG. 3B. The guide posts 150, 152 and the base wall 154 together act to protect the top surface of the wire board 12 (see FIG. 1).

Figure 5:
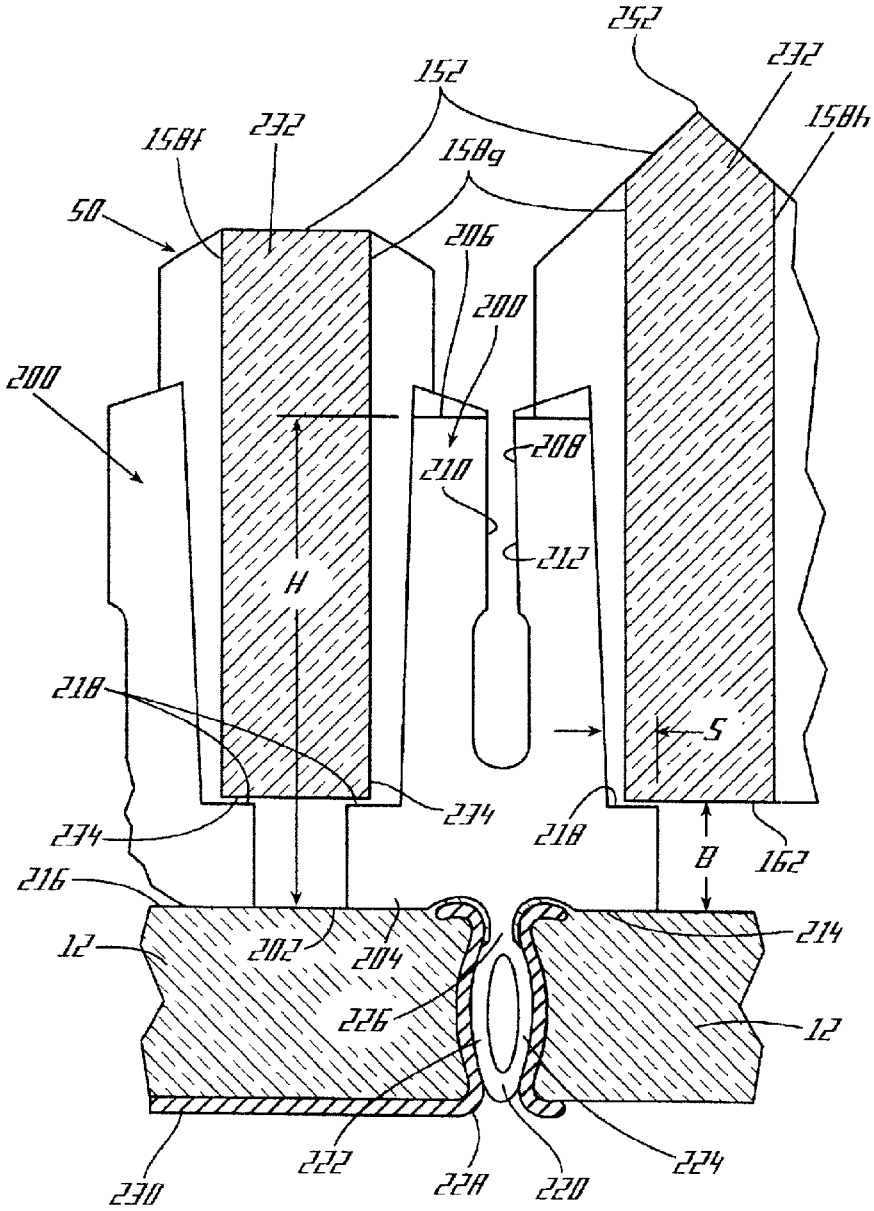
FIG. 5 is an enlarged side elevation view of a connector terminal in the jack of FIG. 1 with the terminal housing in place.

The housing 50 also has a rear apron 156 that protects the rear edge of the wire board 12 when the board is captured between the housing 50 and the cover 60. Wire connecting portions of the IDC terminals 56*a*–56*h* in FIG. 1, are received in corresponding terminal slots 158*a* to 158*h* that open in rows along the bases of a pair of underside channels 160, 162 grooved underneath the housing base wall 154. The underside channels 160, 162 accommodate base portions of the IDC terminals 56*a*–56*h* just above the wire board 12, as illustrated in FIG. 5.

Grooves 130*a*–130*h* provide access to corresponding terminal slots 158*a*–158*h* for the terminal pairs. The grooves 130*a*–130*h* open up into one of two channels 110*a* or 110*b* depending on which side of the housing body 50. The grooves 130*a*–130*h* are angled so as to provide the openings towards the rear of the housing body 50. In this embodiment, the grooves are angled about 30 degrees from the plane of the rear end of the housing body, or, likewise, 60 degrees from an axis normal to the rear end of the housing body. The grooves 130*a*–130*h*, which are separated by adjacent guide posts 150, 152 are angled in such a way so that terminal wire pairs can more easily be guided into them. Additionally, the angled grooves 130*a*–130*h* help to reduce the tendency to open loops in the twisted pair. It should be noted that, generally, the greater the angle that the twisted wire pair must make to be terminated into the terminals 56*a*–56*h*, the more of a tendency there may be for the twists to open loops. This is because of a difference in path length that each wire of the pair must take. Generally, the greater the angle, the greater the difference in wire path length.

Alternating ones of the terminal wire guide posts 150, 152 on housing 50 form sharply pointed or pyramidal top ends 250, 252. The purpose of the pointed ends 250, 252 on the guide posts is to assist in separating each lead of a tightly twisted, unshielded lead pair (not shown) when the lead pair is pressed against one of the ends 250, 252. Each lead of the pair can then be dragged down along a corresponding inclined surface at the top of the post, and between knife edges of an IDC terminal 56 whose edges are exposed inside the terminal slot 158 formed in each of the grooves 130*a*–130*h*. The present construction of the housing 50 is therefore well suited to high data rate applications where tightly twisted, unshielded lead pairs are typically used.

As mentioned above, the grooves 130*a*–130*h* open into one of two channels 110*a* or 110*b*. Channels 110*a* and 110*b* are formed atop the base wall 154. Entry for two wire pairs into the channels 110*a* and 110*b* are provided by two apertures 127*a* and 127*b* (one wire pair for each aperture) at the rear end of the housing body 50. Ramps 115*a* and 115*b* are formed in the two channels 110*a* and 110*b*. The ramps 115*a* and 115*b* incline upward the channels 110*a* and 110*b* from the rear end to the front end. The channels 110*a* and 110*b* guide terminal wire pairs to respective grooves 130*c*–130*d* and 130*g*–130*h* as the wire pairs are entered into the housing 50 through the apertures 127*a* and 127*b*. The ramps 115*a* and 115*b* help guide the wire pairs upward towards the grooves 130*c*–130*d* and 130*g*–130*h*. It may be important for the wire pairs to be self guided upwards so that they can be more easily accessed for dressing. The width of the channels 110*a* and 110*b*, due to the general size of the overall assembly, is relatively small, so accessing the wire pairs from within the channels 110*a* and 110*b* could be difficult. The width of the channels 110*a* and 110*b* may be wide enough, though, such that one wire pair can fit comfortably within each respective channel.

A divider 120 is formed symmetrically along an axis running from rear to front. The divider 120 is formed normal to the plane of the base wall 154 and upwards so as to divide channel 110*a* from channel 110*b*. The absence of the divider 120 would generate one general channel in which all four wire pairs may subside. A portion of the divider 120 may bulge slightly outwards towards respective wire guide posts so as to provide a reinforcement region 135 for the mounting post 52 (not shown).

A separator 125 is formed from atop the rear apron 156 in between opposing wire guide posts. The divider 120 and separator 125 form a cross-like structure at the rear of the housing body 50. The separator 125, divider 120, and the rear apron 156 form the mentioned apertures 127*a* and 127*b* below the separator 125. The separator 125 provides vertical spacing between two stacked wire pairs. The separator 125, in conjunction with the divider 120, provide a quadrant system for spacing wire pairs upon entry into the housing 50 at the rear of the housing 50. Sufficient, and possibly more important, consistent spacing between adjacent wire pairs is critical for reducing coupling between the pairs which, in turn, can reduce crosstalk.

Prongs 140 extend outward from the front end of the housing 50. The prongs 140 are used to help secure the housing 50, the wire board 12, and the cover 60, inside the jack housing 14.

Having described the general structure of the terminal housing body 50, the functional aspects of the housing body 50 will be described in relation to the basic steps of installation of the jack. The wiring termination, which is performed in the field, is one piece of the entire communication channel in which the design/manufacturer has little control. Among other things, consistent wiring termination is accomplished with the described terminal housing body 50. Consistent wiring termination is important because it helps the design/manufacturer more accurately account for errors in the channel.

Upon installation, a first twisted wire pair may be entered through aperture 127*a* into channel 110*a*. As the first twisted wire pair is traversed through the channel 110*a*, it may strike ramp 115*a* and deflect upwards towards grooves 130*c* and 130*d*. The first twisted wire pair is pulled up over the pyramidal top end 250 in such a way so that the pyramidal top end 250 easily separates the first twisted wire pair. The now individual wires enter into grooves 130*c* and 130*d* where IDC terminals 56*c* and 56*d* of the wire board 12 receive and secure the wires. As mentioned earlier, the grooves 130*c* and 130*d* are angled in such a way so that the wire pairs need not be dramatically angled upon entry. This helps reduce the possibility of open loops in the twisted pair which is caused by the difference in path length between the two wires in the twisted pair.

A second twisted pair may be applied through the aperture 127*b* and traversed through channel 110*b*. The second twisted pair is pulled over pyramidal top end 252 and received in grooves 130*g* and 130*h*. The divider 120 achieves proper spacing and acts as a dielectric between the two twisted wire pairs.

A third twisted wire pair can be accepted in grooves 130*a* and 130*b*. The third twisted wire pair can be positioned atop the separator 125 and pulled over the pyramidal top end 250 that is atop the wire guide post that separates grooves 130*a* and 130*b*. In a similar fashion to the first twisted wire pair, the third twisted wire pair is received by IDC terminals 56*a* and 56*b*. The separator 125 provides proper spacing between the first and third twisted pair.

A fourth twisted pair can be accepted in grooves 130*e* and 130*f*. The fourth twisted pair is installed in a similar fashion to the third twisted pair. With the four twisted pairs in place, it becomes evident how the separator 125 and divider 120 produce a quadrant system that provides for proper spacing between adjacent twisted wire pairs.

In other embodiments, the first and second wire pairs may be entered through the apertures 127*a* and 127*b*, respectively. The first and second wire pairs may then be guided towards grooves 130*a–b* and 130*e–f*, respectively. Third and fourth wire pairs can then be placed atop the separator 125 and guided towards grooves 130*c–d* and 130*g–h*. The placement of the wire pairs into particular grooves may vary on how the wire pairs are located in the cable and subsequently how they are clocked by the installer.

A more thorough description of how the wires are received by the IDC terminals is discussed in relation to FIG. 5.

Figure 3A:
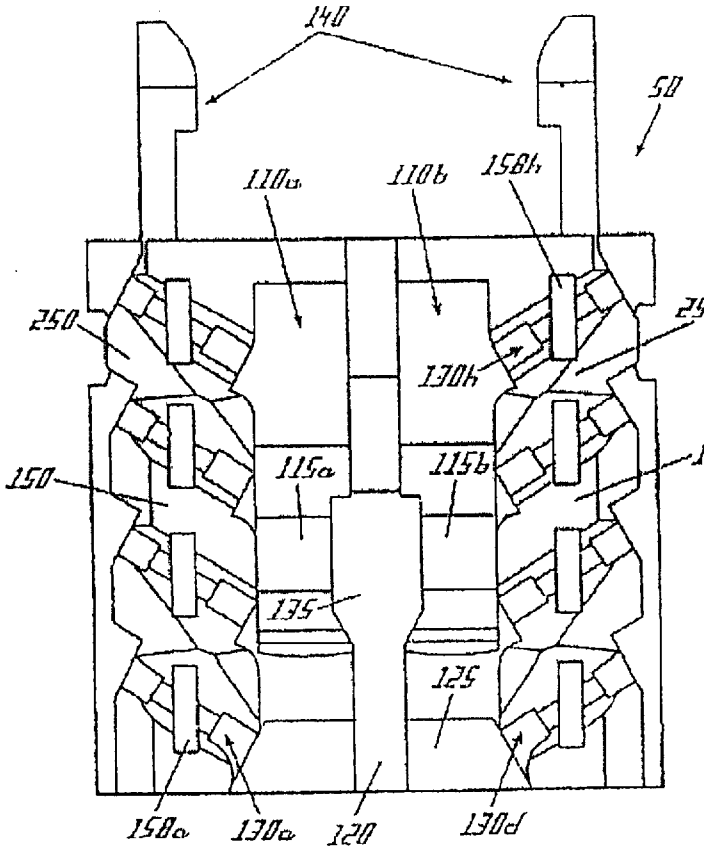
FIG. 3A is a top view of the terminal housing of FIG. 1 and FIG. 2.

In the discussion that follows, both FIG. 3A and FIG. 3B will be discussed. FIG. 3A is a top view of the terminal housing 50 of FIG. 1 and FIG. 2 and FIG. 3B is a bottom view of the terminal housing 50 of FIG. 1, FIG. 2, and FIG. 3A. The top view in FIG. 3A provides better detail to the layout of the grooves 130*a–h*, the terminal slots 158*a–h* and the wire guide posts 150, 152. The bottom view of the terminal housing 50 shows the mounting post 52 that is formed and extending from the base wall 154. In other embodiments, a second mounting or fastening post may be provided.

Figure 4B:
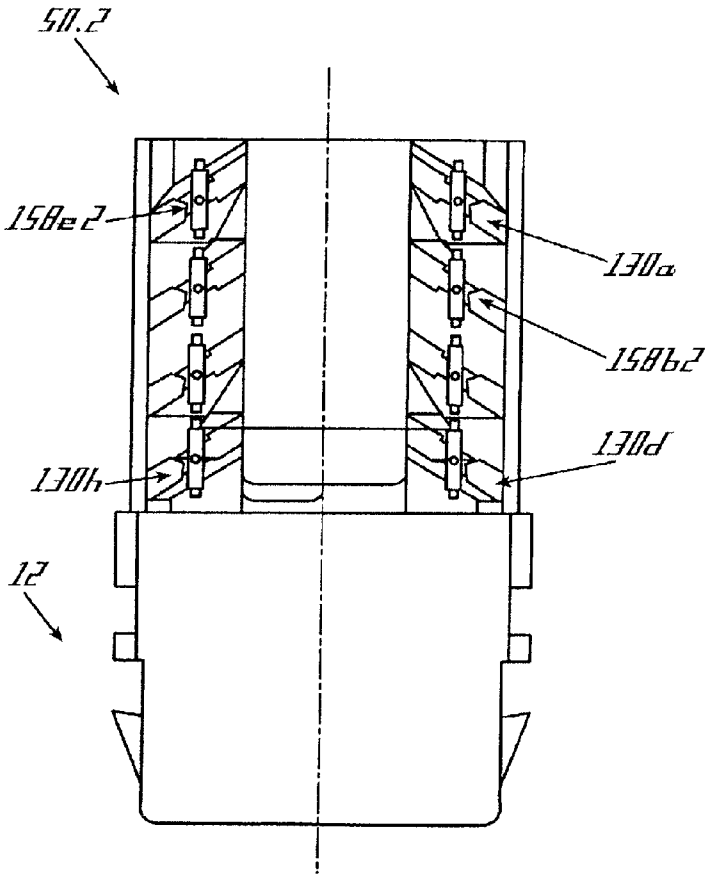
FIG. 4B is a top view of another embodiment of the jack assembly of FIG. 1 with emphasis being placed on the insulation displacement connectors (IDCs).
Figure 4A:
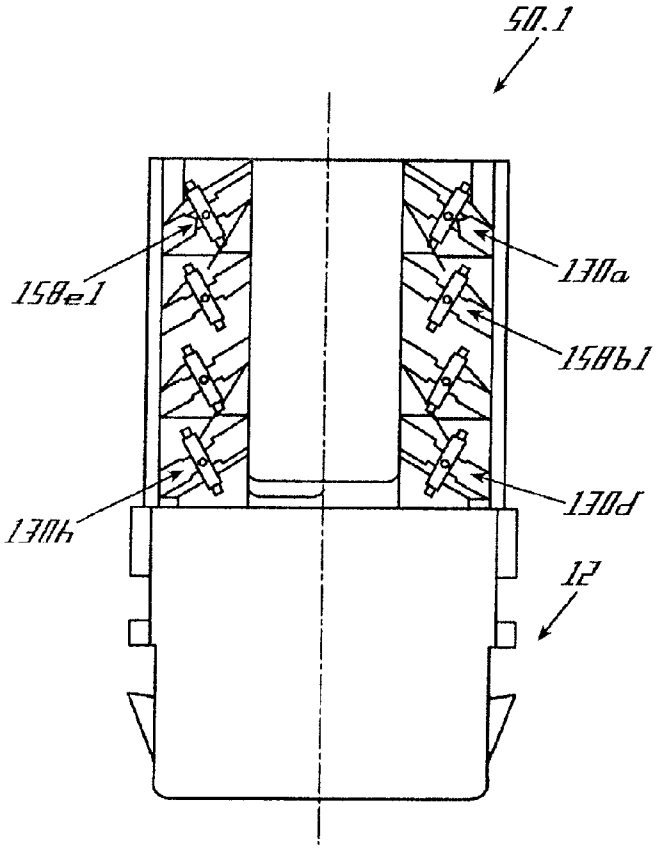
FIG. 4A is a top view of an embodiment of the communication jack assembly in cooperation with the terminal housing of FIG. 1.

FIG. 4A and FIG. 4B represent the variation in the placement and form of the terminal slots 158*a–h* and subsequently the IDC terminals 56*a–h* in accordance with differing embodiments of the present invention. Terminal housing 50.1 shows the terminal slots 158*a*1-*h*1 substantially normal to the direction of the grooves 130*a–h*. Terminal housing 50.2 shows the terminal slots 158*a*2-*h*2 substantially parallel to a central axis that runs from the rear end to the front end of the terminal housing 50.2.

It should be noted, however, in other embodiments the angle in which the terminal slots 158*a–h* are positioned relative to the grooves 130*a–h* may vary. Variations in the angle of the grooves 130-*h* and the variation in the placement of the terminal slots 158*a–h* may be needed to improve spacing which may improve electrical performance or, perhaps, for manufacturing reasons.

FIG. 5 is an enlarged side elevational view of an IDC terminal 200 for use in the present communications jack 10. The terminal 200, similar to terminals 56*a*–56*h*, preferably has the following features detailed in connection with FIG. 5. Terminal 200 may be formed of a metallic material such as, for example, a copper alloy having a thickness of about 0.015 inches, and with a bright solder finish of between 0.1 and 0.3 mils thick. The height H of terminal 200 is preferably about 0.230 inches between a bottom edge 202 of a mounting base portion 204, and an upper inside sharp ledge 206 on both sides of an insulated wire receiving groove 208 in the terminal 200. As is known generally in the art, when an insulated wire conductor is held at the top of an IDC terminal and is pushed down within a terminal groove, opposed ledges such as ledges 206 will cut through the insulation on the conductor and establish electrical contact via side surfaces 210, 212 between the conductor and the IDC terminal 200. A typical width of the groove 208 is about 0.012 inches.

The mounting base portion 204 has a bottom edge 214 portions of which align flush with a top surface 216 of the wire board 12 on which the IDC terminal 200 is mounted. A top part of the base portion 204 defines a shoulder 218 that protrudes a certain distance S from the wire receiving portion of the terminal 200. The shoulder 218 is at a determined height B above the bottom edge 214 of the base portion 204. Typical dimensions are S=about 0.025 inches and B=about 0.053 inches.

The IDC terminal 200 also has a wire board mounting part 220 with a generally "needle-eye" appearance. The board mounting part 220 comprises opposed arcuate sections 222, 224 joined to the bottom edge 214 of the terminal by a common stem 226. The arcuate sections 222, 224 have an inner radius of typically about 0.083 inches and an outer radius of typically about 0.094 inches. The height of the "eye" opening defined between the sections 222, 224 is typically about 0.056 inches and the width of the opening about 0.014 inches. The width of the metal strips forming the sections 222, 224 is typically about 0.011 inches. The entire IDC terminal 200 including its base portion 204 and board mounting part 220 are preferably stamped from a single sheet of metallic material.

An important feature of the IDC terminal 200 is that its wire board mounting part 220 can establish reliable electrical contact with a plated opening 228 in the wire board 12, if the diameter of the opening 228 is slightly less than the overall width (e.g., 0.035 inches) of the "needle-eye" mounting part 220. That is, the mounting part 220 can be urged in the direction of the axis of the opening 228 to mount the terminal 200 on the board 12, and the arcuate sections 222, 224 are urged resiliently toward one another to maintain positive electrical contact with the plated wall of the board opening 228. A conductive path 230 on the board 12 which connects with the plating of opening 228, is thus electrically connected to the terminal 200. It has been discovered that no further bonding such as solder is necessary to maintain electrical contact between the terminal 200 and the conductive plating of the wire board opening 228.

Another desirable feature of the IDC terminal 200 in FIG. 5, is that it is held securely in place on the wire board 12 via a part of the terminal housing body that abuts the shoulder 218 when the housing 50 is joined to the cover 60 through the wire board 12. That is, a wire conductor can be repeatedly inserted and withdrawn from the groove 208 in the terminal 200 without substantially dislocating the terminal, and without causing mounting part 220 to lose contact with a conductive path that leads to the terminal mounting hole. That is, the terminal 200 is captured between the wire board 12 and the body of the connector housing 50 once the terminal 200 is inserted in a corresponding one of slots 158*a*–158*h* in the housing 50, and the housing 50 is joined to the cover 60 with the wire board 12 sandwiched between them.

Specifically, the terminal slots 158*a*–158*h* opening at the bases of the underside channels 160, 162 in the housing base wall 154 (not shown) are separated by partitions 232 formed in the body of the terminal housing 50. Each partition 232 separates adjacent ones of the terminal wire guide posts 150, 152 on the housing 50. The terminal slots 158*a*–158*h* are only sufficiently wide to receive the IDC terminals 200 down to the top of the terminal base shoulders 218. Bottom corners 234 of the partitions 232 are positioned in confronting relation to the terminal shoulders 218 when the terminals are mounted on the wire board 12 as in FIG. 5. Thus, once a wire is pushed down in the receiving groove 208 of the terminal 200, and the wire is later pulled upward in FIG. 5 to be disconnected from the terminal, vertical displacement of the terminal 200 is stopped by the bottom corners 234 of the partitions 232. It will be appreciated that some limited vertical movement of the terminal 200 can be tolerated since its board mounting part 220 is not soldered in the board opening 228 and sliding electrical contact with the plated wall of the opening 228 can be maintained.

The contact wires 18*a*–18*h* (See FIG. 1) and the IDC terminals 56*a*–56*h* are operatively mounted the wire board without the need for solder. The IDC terminals 56*a*–56*h* and contact wires 18*a*–18*h* have compliant "needle-eye" mounting parts that enhance their electrical connection with conductive paths on the wire board 12. The housing 50 when joined to the cover 60 engages shoulders 218 of the IDC terminals 200 and secures said terminals to the wire board.

The low-profile IDC terminal 200 disclosed herein is suitable for mounting on a printed wire board. The terminal 200 includes at least one shoulder 218 that not only assists in the insertion of the terminal into the wire board 12, but also cooperates with a part of the housing 50 to keep the terminal in place on the wire board when, for example, a wire is withdrawn out of the terminal. Although wires are not usually pulled out from IDC terminals, rearrangements are not uncommon. The mentioned "needle-eye" structure for the mounting part of the terminal 200 is a compliant structure that may be slightly larger than a plated wire board hole in which it is inserted. Because the terminal shoulder 218 cooperates with part of the housing 50 to hold the terminal in place, the terminal need not be soldered on the wire board.

While the foregoing description represents preferred embodiments of the invention, it will be obvious to those skilled in the art that various changes and modifications may be made, without departing from the true spirit and scope of the invention. Such modifications include, but are not limited to, the use of discrete components on the wire board 12 to reduce crosstalk, and the use of metallic terminal strips (e.g., "110" type connectors) preloaded into a dielectric housing prior to installation on the wire board.

Further, the fastening arrangement between the terminal housing 50 and cover 60 is shown in the drawing as comprising at least one fastening post projecting from beneath the housing, and an opening in the cover that surrounds the tip of the post. Equivalent arrangements are also within the scope of the invention; for example, an arrangement wherein at least one fastening post projects from the cover, and a tip of the post is surrounded by an opening in the housing base wall to be fused to the wall.

All such modifications and variations are intended to be included herein within the scope of the present invention and protected by the following claims.

What is claimed is:

1. A terminal housing body for receiving a wire pair, said terminal housing body having a front end and a rear end, said terminal housing body comprising:

a base wall having a top portion;

a channel formed in said ton portion of said base wall for receiving the wire pair and extending from the rear end toward the front end, said channel adapted to guide the direction of the wire pair;

a plurality of wire guide posts extending from said top portion and joined by said base wall and running along opposing sides of said top portion of said base wall from the rear end to the front end of said terminal housing body;

grooves separated by adjacent ones of said wire guide posts, said grooves having openings into said channel for receiving the wires of the wire pair; and a ramp formed in said channel inclined upward from the rear end to the front end of said terminal housing body for guiding the wire pair upwards toward a pair of said grooves.

2. The terminal housing body of claim 1, further comprising:

a separator located at the rear end of said housing body for providing a pair of apertures of said first and second channels, the pair of apertures formed by said separator joined with said divider and opposing ones of said wire guide posts;

said separator for separating the first wire pair from a third wire pair and the second wire pair from a fourth wire pair; and the pair of apertures for receiving the first and the second wire pairs.

3. The terminal housing body of claim 1, wherein said grooves are angled toward the rear end of said terminal housing body for receiving the wire pair.

4. The terminal housing body of claim 1, wherein said grooves are angled at approximately 60 degrees from a reference line normal to the rear end of said terminal housing body, such that the openings of said grooves are angled toward the rear end of the terminal housing body.

5. The terminal housing body of claim 1, further comprising a plurality of terminal slots formed in corresponding grooves by adjacent ones of said wire guide posts for receiving wire connecting portions of corresponding connector terminals of a wire board.

6. The terminal housing body of claim 5, wherein each one of said terminal slots is positioned substantially normal to the direction of said corresponding groove.

7. The terminal housing body of claim 5, wherein each one of said terminal slots is positioned substantially parallel to the reference line normal to the rear end of said terminal housing body.

8. The terminal housing body of claim 5, wherein said wire guide posts have associated pyramidal top ends to assist in separating twisted wires of the wire pair to be connected to the wire connecting portions of the connector terminals.

9. The terminal housing body of claim 1, wherein said base wall is dimensioned and arranged to be placed on a wire board at a wire connection terminal region of the wire board;

said base wall comprises an underside channel formed underneath said base wall for receiving base portions of a plurality of connector terminals mounted on the wire board, and the terminal housing body has a row of terminal slots that open into the underside channel for receiving wire connecting portions of corresponding ones of the connector terminals, and the base portions of the terminals form shoulders that protrude a certain distance from the wire connecting portions; and said terminal housing body includes partitions between the terminal slots, each of which partitions has a bottom part defining a base of said underside channel for confronting the shoulders of the connector terminals and for restraining the terminals from movement relative to the wire board when said terminal housing body is placed on the wire board, and the wire connecting portions of the connector terminals are received in the terminal slots in the terminal housing body.

10. A terminal housing body for receiving a wire pair, said terminal housing body having a front end and a rear end, said terminal housing body comprising:

a base wall having a top portion;

a channel formed in said top portion of said base wall for receiving the wire pair and extending from the rear end toward the front end, said channel adapted to guide the direction of the wire pair;

a plurality of wire guide posts extending from said top portion and joined by said base wall and running along opposing sides of said top portion of said base wall from the rear end to the front end of said terminal housing body;

grooves separated by adjacent ones of said wire guide posts, said grooves having openings into said channel for receiving the wires of the wire pair; and a divider for dividing said channel into a first channel and a second channel, the first channel being adapted to receive the first wire pair and the second channel being adapted to receive a second wire pair, the wire pairs being separated by said divider.

11. The terminal housing body of claim 10, further comprising:

a separator located at the rear end of said housing body for providing a pair of apertures of said first and second channels, the pair of apertures formed by said separator joined with said divider and opposing ones of said wire guide posts;

said separator for separating the first wire pair from a third wire pair and the second wire pair from a fourth wire pair; and the pair of apertures for receiving the first and the second wire pairs.

12. The terminal housing body of claim 11, wherein the first and the third wire pairs are separated horizontally from the second and fourth wire pairs by said divider and the third and the fourth wire pairs are separated vertically from the first and the second wire pairs, respectively, by said separator.

13. The terminal housing body of claim 10, wherein said grooves are angled toward the rear end of said terminal housing body for receiving the wire pair.

14. The terminal housing body of claim 13, wherein said grooves are angled at approximately 60 degrees from a reference line normal to the rear end of said terminal housing body, such that the openings of said grooves are angled toward the rear end of the terminal housing body.

15. The terminal housing body of claim 13, further comprising a plurality of terminal slots formed in corresponding grooves by adjacent ones of said wire guide posts for receiving wire connecting portions of corresponding connector terminals of a wire board.

16. The terminal housing body of claim 15, wherein each one of said terminal slots is positioned substantially normal to the direction of said corresponding groove.

17. The terminal housing body of claim 15, wherein each one of said terminal slots is positioned substantially parallel to the reference line normal to the rear end of said terminal housing body.

18. The terminal housing body of claim 15, wherein said wire guide posts have associated pyramidal top ends to assist in separating twisted wires of the wire pair to be connected to the wire connecting portions of the connector terminals.

19. The terminal housing body of claim 10, wherein said base wall is dimensioned and arranged to be placed on a wire board at a wire connection terminal region of the wire board;

said base wall comprises an underside channel formed underneath said base wall for receiving base portions of a plurality of connector terminals mounted on the wire board, and the terminal housing body has a row of terminal slots that open into the underside channel for receiving wire connecting portions of corresponding ones of the connector terminals, and the base portions of the terminals form shoulders that protrude a certain distance from the wire connecting portions; and said terminal housing body includes partitions between the terminal slots, each of which partitions has a bottom part defining a base of said underside channel for confronting the shoulders of the connector terminals and for restraining the terminals from movement relative to the wire board when said terminal housing body is placed on the wire board, and the wire connecting portions of the connector terminals are received in the terminal slots in the terminal housing body.

20. A communication jack assembly comprising:

a terminal housing portion for receiving a first wire pair, said terminal housing portion having a front end and a rear end, said terminal housing portion comprising:

a base wall having a top portion;

a channel formed in said top portion of said base wall for receiving the wire pair and extending from the rear end toward the front end, said channel adapted to guide the direction of the wire pair;

a plurality of wire guide posts extending from said top portion and joined by said base wall and running along opposing sides of said toy portion of said base wall from the rear end to the front end of said terminal housing body; and grooves separated by adjacent ones of said wire guide posts and having openings into said channel for receiving the wires of the wire pair;

wherein the terminal housing portion further comprises a ramp formed in said channel inclined upward from the rear end to the front end of said terminal housing portion for guiding the wire pair upwards toward a pair of said grooves.

21. The communication jack assembly of claim 20, wherein the terminal housing portion further comprises:

a separator located at the rear end of said housing body for providing a pair of apertures of said first and second channels, the pair of apertures formed by said separator joined with said divider and opposing ones of said wire guide posts;

said separator for separating the first wire pair from a third wire pair and the second wire pair from a fourth wire pair; and the pair of apertures for receiving the first and the second wire pairs.

22. The communication jack assembly of claim 20, wherein said grooves are angled toward the rear end of said terminal housing portion for receiving the wire pair.

23. The communication jack assembly of claim 22, wherein said grooves are angled at approximately 60 degrees from a reference line normal to the rear end of said terminal housing portion, such that the openings of said grooves are angled toward the rear end of the terminal housing portion.

24. The communication jack assembly of claim 22, further comprising:

a wire board having a wire connection terminal region;

a plurality of connector terminals aligned on the wire connection terminal region of the wire board, each of said connector terminals having a wire connecting portion for connecting outside wires with said region, a base portion forming at least one shoulder that protrudes a certain distance from the wire connecting portion of the terminal, and a wire board mounting part projecting below the mounting base portion to engage a corresponding terminal opening in the wire board.

25. The communication jack assembly of claim 24, wherein said terminal housing portion further comprises a plurality of terminal slots formed in corresponding grooves by adjacent ones of said wire guide posts for receiving wire connecting portions of corresponding connector terminals of the wire board.

26. The communication jack assembly of claim 25, wherein each one of said terminal slots is positioned substantially normal to the direction of said corresponding groove.

27. The communication jack assembly of claim 25, wherein each one of said terminal slots is positioned substantially parallel to the reference line normal to the rear end of said terminal housing portion.

28. The communication jack assembly of claim 24, wherein said wire guide posts have associated pyramidal top ends to assist in separating twisted wires of the at least first wire pair to be connected to the wire connecting portions of said connector terminals.

29. A communication jack assembly comprising:

a terminal housing portion for receiving a first wire pair, said terminal housing portion having a front end and a rear end, said terminal housing portion comprising:

a base wall having a top portion;

a channel formed in said top portion of said base wall for receiving the wire pair and extending from the rear end toward the front end, said channel adapted to guide the direction of the wire pair;

a plurality of wire guide posts extending from said top portion and joined by said base wall and running along opposing sides of said top portion of said base wall from the rear end to the front end of said terminal housing body; and grooves separated by adjacent ones of said wire guide posts and having openings into said channel for receiving the wires of the wire pair;

wherein the terminal housing portion further comprises a divider for dividing said channel into a first channel and a second channel, the first channel being adapted to receive the first wire pair and the second channel being adapted to receive a second wire, the wire pairs being separated by said divider.

30. The communication jack assembly of claim 29, wherein the terminal housing portion further comprises:

a separator located at the rear end of said housing body for providing a pair of apertures of said first and second channels, the pair of apertures formed by said separator joined with said divider and opposing ones of said wire guide posts;

said separator for separating the first wire pair from a third wire pair and the second wire pair from a fourth wire pair; and the pair of apertures for receiving the first and the second wire pairs.

31. The communication jack assembly of claim 30, wherein the first and the third wire pairs are separated horizontally from the second and fourth wire pairs by said divider and the third and the fourth wire pairs are separated vertically from the first and the second wire pairs, respectively, by said separator.

32. The communication jack assembly of claim 29, wherein said grooves are angled toward the rear end of said terminal housing portion for receiving the wire pair.

33. The communication jack assembly of claim 32, wherein said grooves are angled at approximately 60 degrees from a reference line normal to the rear end of said terminal housing portion, such that the openings of said grooves are angled toward the rear end of the terminal housing portion.

34. The communication jack assembly of claim 32, further comprising:

a wire board having a wire connection terminal region;

a plurality of connector terminals aligned on the wire connection terminal region of the wire board, each of said connector terminals having a wire connecting portion for connecting outside wires with said region, a base portion forming at least one shoulder that protrudes a certain distance from the wire connecting portion of the terminal, and a wire board mounting part projecting below the mounting base portion to engage a corresponding terminal opening in the wire board.

35. The communication jack assembly of claim 34, wherein said terminal housing portion further comprises a plurality of terminal slots formed in corresponding grooves by adjacent ones of said wire guide posts for receiving wire connecting portions of corresponding connector terminals of the wire board.

36. The communication jack assembly of claim 35, wherein each one of said terminal slots is positioned substantially normal to the direction of said corresponding groove.

37. The communication jack assembly of claim 35, wherein each one of said terminal slots is positioned substantially parallel to the reference line normal to the rear end of said terminal housing portion.

38. The communication jack assembly of claim 34, wherein said wire guide posts have associated pyramidal top ends to assist in separating twisted wires of the at least first wire pair to be connected to the wire connecting portions of said connector terminals.

39. A terminal housing body having a front end and a rear end, said terminal housing body comprising:

a base wall having a top portion;

a first channel formed in said top portion of said base wall for receiving a first wire pair and extending from the rear end toward the front end;

a second channel formed in said top portion of said base wall for receiving a second wire pair and extending from the rear end toward the front end;

a plurality of wire guide posts extending from said top portion and joined by said base wall and running along opposing sides of said top portion of said base wall from the rear end to the front end of said terminal housing body;

grooves separated by adjacent ones of said wire guide posts and having openings into one of said first or second channel for receiving the wires of the wire pairs; and a divider formed from said base wall and extending upwards for separating said first channel from said second channel.

40. The terminal housing body of claim 39, further comprising:

a separator located at the rear end of said housing body for providing a pair of apertures of said first and second channels, the pair of apertures formed by said separator joined with said divider and opposing ones of said wire guide posts;

said separator for separating the first wire pair from a third wire pair and the second wire pair from a fourth wire pair; and the pair of apertures for receiving the first and the second wire pairs.

41. The terminal housing body of claim 40, wherein the first and the third wire pairs are separated horizontally from the second and fourth wire pairs by said divider and the third and the fourth wire pairs are separated vertically from the first and the second wire pairs, respectively, by said separator.

42. The terminal housing body of claim 39, further comprising ramps formed in said first and second channels inclined upward from the rear end to the front end of said terminal housing body for guiding the first and second wire pairs upwards toward pairs of said grooves.

43. The terminal housing body of claim 39, wherein said grooves are angled toward the rear end of said terminal housing body for receiving the first and second wire pair.

44. The terminal housing body of claim 43, wherein said grooves are angled at approximately 60 degrees from a reference line normal to the rear end of said terminal housing body, such that the openings of said grooves are angled toward the rear end of the terminal housing body.

45. The terminal housing body of claim 43, further comprising a plurality of terminal slots formed in corresponding grooves by adjacent ones of said wire guide posts for receiving wire connecting portions of corresponding connector terminals of a wire board.

46. The terminal housing body of claim 45, wherein each one of said terminal slots is positioned substantially normal to the direction of said corresponding groove.

47. The terminal housing body of claim 45, wherein each one of said terminal slots is positioned substantially parallel to the reference line normal to the rear end of said terminal housing body.

48. The terminal housing body of claim 45, wherein said wire guide posts have associated pyramidal top ends to assist in separating twisted wires of the first and second wire pairs to be connected to the wire connecting portions of the connector terminals.

49. The terminal housing body of claim 39, wherein said base wall is dimensioned and arranged to be placed on a wire board at a wire connection terminal region of the wire board;

said base wall comprises an underside channel formed underneath said base wall for receiving base portions of a plurality of connector terminals mounted on the wire board, and the terminal housing body has a row of terminal slots that open into the underside channel for receiving wire connecting portions of corresponding ones of the connector terminals, and the base portions of the terminals form shoulders that protrude a certain distance from the wire connecting portions; and said terminal housing body includes partitions between the terminal slots, each of which partitions has a bottom part defining a base of said underside channel for confronting the shoulders of the connector terminals and for restraining the terminals from movement relative to the wire board when said terminal housing body is placed on the wire board, and the wire connecting portions of the connector terminals are received in the terminal slots in the terminal housing body.

* * * * *